US006508569B2

(12) United States Patent
Krietzman et al.

(10) Patent No.: US 6,508,569 B2
(45) Date of Patent: Jan. 21, 2003

(54) SLIDE-SWITCHED FLAT ILLUMINATOR

(76) Inventors: Mark Howard Krietzman, P.O. Box 3185, Palos Verdes, CA (US) 90274; Yu-Hsin Chen, P.O. Box 3185, Palos Verdes, CA (US) 90274

( * ) Notice: Subject to any disclaimer, the term of this patent is extended or adjusted under 35 U.S.C. 154(b) by 5 days.

(21) Appl. No.: 09/851,861

(22) Filed: May 8, 2001

(65) Prior Publication Data

US 2001/0048597 A1 Dec. 6, 2001

Related U.S. Application Data

(60) Provisional application No. 60/202,894, filed on May 10, 2000, and provisional application No. 60/253,188, filed on Nov. 27, 2000.

(51) Int. Cl.[7] ..... F21L 4/04

(52) U.S. Cl. ..... 362/201; 362/189; 362/200; 362/800; 362/253; 362/802

(58) Field of Search ..... 362/189, 200, 362/201, 800, 184, 168, 253, 802

(56) References Cited

U.S. PATENT DOCUMENTS

| | | | | | |
|---|---|---|---|---|---|
| 4,250,539 | A | * | 2/1981 | Leitzel et al. | 362/200 |
| 5,318,177 | A | * | 6/1994 | Isacson | 362/253 |
| 5,893,631 | A | | 4/1999 | Padden | |
| 5,927,846 | A | | 7/1999 | Sinclair | |
| 6,039,454 | A | * | 3/2000 | Hallgrimsson | 362/200 |
| 6,070,990 | A | * | 6/2000 | Dalton et al. | 362/189 |
| 6,109,762 | A | | 8/2000 | Hallgrimsson | |
| 6,190,018 | B1 | * | 2/2001 | Parsons et al. | 362/200 |

* cited by examiner

*Primary Examiner*—Stephen Husar
*Assistant Examiner*—Guiyoung Lee
(74) *Attorney, Agent, or Firm*—Mark Krietzman

(57) ABSTRACT

A flat illuminator, which may have a replaceable battery power supply and with a sliding inner body forming an "on" and "off" switch.

29 Claims, 2 Drawing Sheets

SLIDE-SWITCHED FLAT ILLUMINATOR

RELATED APPLICATIONS

The invention claims the benefit, under Title 35, United States Code 119 (e), of Provisional Patent Applications: No. 60/202,894, filed May 10, 2000, entitled "Flat Illuminator" and, No. 60/253,188, filed Nov. 27, 2000, entitled "Side Switched Flat Illuminator" and is also related to Applicants' pending application filed Dec. 19, 2000, entitled "Side Switched Flat Illuminator" Ser. No. 09/740,472.

BACKGROUND OF THE INVENTION

1. Field of the Invention

This present invention relates to a miniature flat flashlight. More particularly to a plastic card light which illuminates with one or more light-emitting diodes, powered by a single or multiple battery power supply with a slide switch.

2. Related Art

Card lights known in the art employ a variety of mechanisms to achieve pressure actuated momentary "on" switching (see generally, U.S. Pat. Nos. 6,070,990, and 6,109,762). One card-like light described in U.S. Pat. No. 5,893,631 issued to Padden moves a single battery, relative to a lead wire of a light bulb or LED, to form a switch. The battery and light bulb remain within the casing and the switch is momentary in its function.

Absent in the art is a card light with an outer casing and sliding inner body forming a slideable "on" switch.

SUMMARY OF INVENTION

The invention herein is a flat card light. Certain terminology will be used in the following specification, for convenience and reference and not as a limitation, brief definitions are provided below:

A. "Button battery " or "button batteries" as used herein refer to one or more coin-type battery including but not limited to batteries containing lithium, and with a thickness of between about 0.25 and about 3.0 millimeters and a diameter of between about 10 and about 40 millimeters.

B. "LED" as used herein refers to a light emitting diodes, circular, oval, square, flat, rectangular and flat. LED also includes, but is not limited to, those light emitting diodes which produce a constant output or a blinking output, in a narrow wavelength associated with a specific spectral region, (visible or non-visible) such as red light, blue light, or yellow light, IR, UV and those which produce a wide spectrum output comprising more than one distinct spectral region of light.

C. "Representational material" as used herein refers to information, picture, graphics, codes, glyphs, icons, trademarks, logos, visual patterns, art, photographs, digital images, promotional literature, symbols or characters.

In some embodiments the card light is no thicker than the LED (FIG. 1B). The card light may have the battery supply permanently or replaceably fixed within the inner body which nests, movably, within the outer casing (FIG. 1A). In one embodiment each of the two LED lead wires rest beneath a stack of one or more batteries, one lead wire against a positive battery terminal and one lead wire against a negative battery terminal. A switching contact attached to, or formed as part of, the outer casing switchably links the two stacks of batteries (FIG. 1D), thereby supplying current to the LED.

In other embodiments, (FIG. 2E & 3A) a single battery stack is provided and the switching contact connects one of battery's terminals to a lead wire. On any of the embodiments Promotional material may be, affixed to, or stenciled on the outer casing (FIGS. 1A & 1D) or the inner body (FIG. 2C).

In other embodiments a tabbed LED (FIG. 2A & 3A) is fitted into place within the inner body, allowing for easy assembly.

The features of the invention believed to be novel are set forth with particularity in the appended claim. The invention itself, however, both as to configuration, and method of operation, and the advantages thereof, may be best understood by reference to the following specification, abstract, claims and accompanying drawings.

MODES FOR CARRYING OUT THE PREFERRED EMBODIMENTS OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 2A:
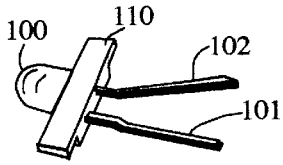
FIG. 2A is a tabbed LED for use with the card light.
Figure 3A:
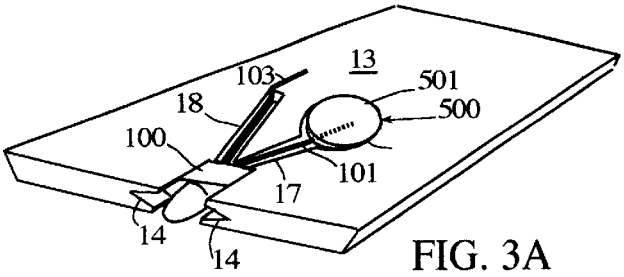
FIG. 3A is a top view of a fourth alternate embodiment of the card light.

The preferred embodiment of the card light (FIGS. 1A–1D) generally designated 10, is a two part device. The outer casing 11 is a substantially planar semi-rigid plastic body shell with an open bottom forming an inner body receiving catch 12 through one or more of the sides or ends. The inner body 13 has an LED mount 14 into which the LED 100 is affixed, either by a pressure fit, (FIG. 2A) adhesive, or by a catch (FIG 3A), a first and a second battery holster 15 & 16, (each adapted to receive a stack of one or more batteries), and a first and second open channel lead wire guide 17 & 18.

When assembled, the first lead wire 101 rests with the first open channel lead wire guide 17, which traverses from the LED mount 14 to the first battery holster 15, and the second wire 102 rests within the second open channel lead wire guide 18, which traverses from the LED mount 14 to the second battery holster 16. A first stack of batteries 500 is placed in the first battery holster 15 with a firs terminal located on its bottom in conductive contact with the first lead wire 101, and the second stack of batteries 510 is placed in the second battery holster 16 with a first terminal located on its bottom in conductive contact with the second lead wire 102.

Figure 1D:
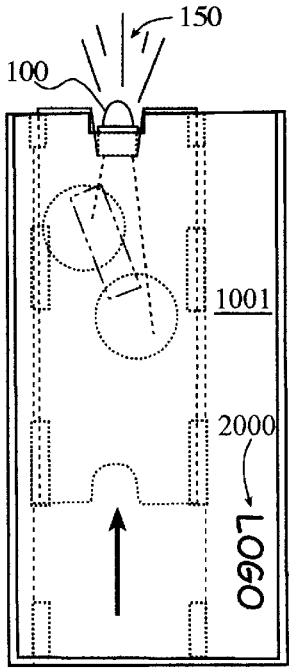
FIG. 1D is a top assembled view of the embodiment shown in FIG. 1A.
Figure 2B:
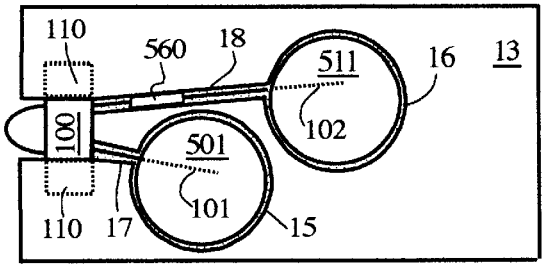
FIG. 2B is a top view of a first alternate embodiment of the inner body of the card light adapted to mount the tabbed LED of FIG. 2A
Figure 2C:
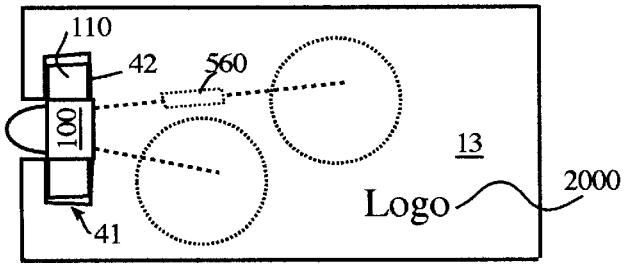
FIG. 2C is a bottom view of the embodiment of FIG. 2B.

The inner body 13, (containing the LED and batteries), is then inserted into the receiving catch 12 of the outer casing 11. The angular edge 19 of the inner body 13 mates movably with the receiving catch 12 The bottom of the inner body 13 is held about even with the bottom portions of the outer casing 11. To actuate the card light, the user aligns a contact strip 550, affixed to, or formed as part of, the top wall of the receiving catch 13 by moving the inner body 13 forward within the receiving catch 12 and thereby extending the LED forward beyond the outer casing 11. When the respective second terminals 501 & 511 each on the top of each stack of batteries 500 & 510 are placed in conductive contact with the contact strip 550, the second terminals 501 and 511 are serial linked, as shown in FIG. 1D, current is supplied to the LED 100 which illuminates 150. An area of promotional information 2000 may be printed on, or otherwise affixed to the outer casing 11 or the inner body 13 (FIG. 2C).

Figure 1A:
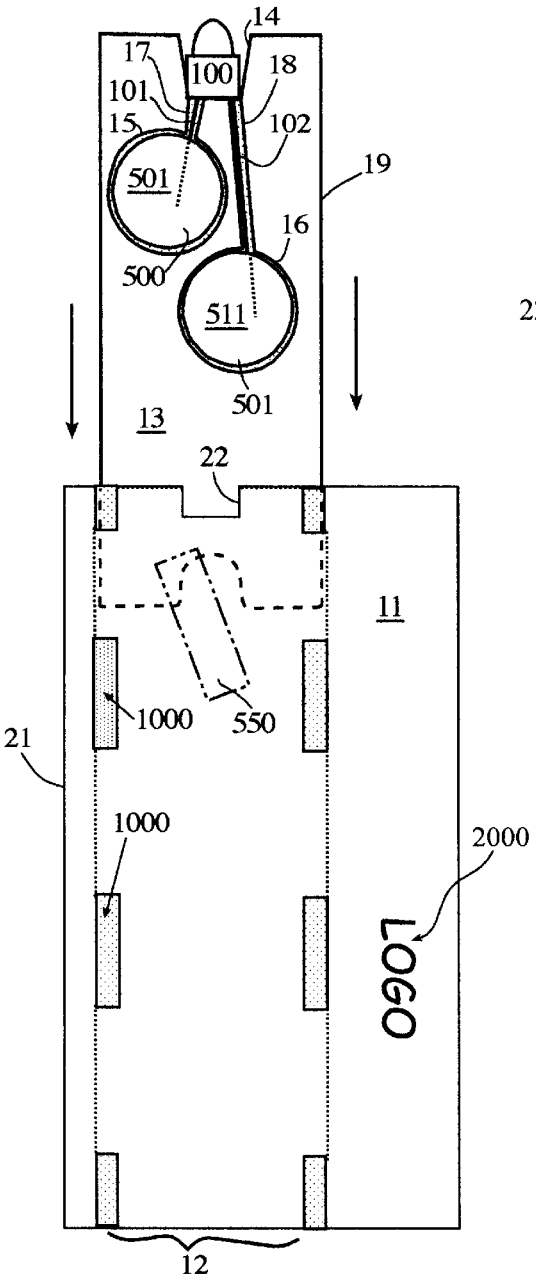
FIG. 1A is an assembly view of the preferred embodiment of the card light.
Figure 1B:
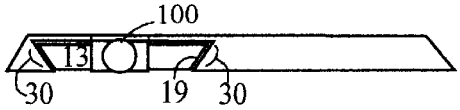
FIG. 1B is a front view of the embodiment shown in FIG. 1A.
Figure 1C:
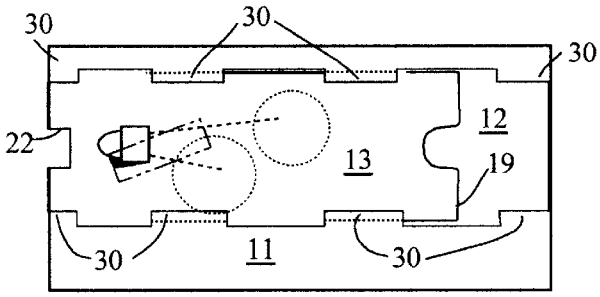
FIG. 1C is a bottom view of the embodiment shown in FIG. 1A.

One method of forming the outer casing 11, well suited for injection molding, is to form the angular catching edges 30 of the receiving catch 12 as a plurality of angled projections (FIG. 1B). One way to form the catching edges 30, with a simple tool, is to have tool guides slots 1000 through the top surface of the outer casing 11 corresponding to the formation of each catching edge 30 result when the outer casing 11 is formed. A tool guide cover 1001 constructed of textured or flat material may also contain promotional material 2000, and may be affixed to the outer casing 11 as shown in FIG. 1D. A non-exhaustive list of suitable construction materials for the optional tool guide cover 1001 includes labels, tape, coated paper, plastic rubberized plastic, silicone, rubber, impregnated paper, polypropylene, vinyl, polyethylene, ABS, styrene, polycrbonate, laminated paper, or Mylar.

To maintain a very thin profile (FIG. 1B) the thickness 21 of the outer casing 11 need be no greater than about the thickness of the selected LED 100. An LED guide slot 22 may be formed in the top surface of the outer casing 11 to nest the LED 100 and maintain minimum thickness 21. A circular LED 100 (FIG. 1B) may be one of the "HLMA-QH00-UW011 Subminiature High Performance AllnGAP LED lamps" manufactured by Agilent Technologies, or one of the "KM2520xxx001, 002 or 003 Subminiature Solid State Led Lamps, manufactured by King Bright. A flat LED, similar to the "HSMx-C1110/170/190/C191 High Performance ChipLED" manufactured by Agilent Technologies, Inc., or the "ESM-3070" series LED, manufactured by Elekon Industries, in Torrance, Calif., or an oval shaped LED such as the IHD 2651 or the IGD 2651 "2×3 mm Oblong" manufactured by IDEA, Inc., in Brea may also be used. The indication of a circular, oblong or flat LED is not intended as a limitation on the scope of the invention, and the choice of LED will be a function of the battery supply and intended usage.

A suitable battery supply 500 & 510 may include, in each stack, one or more of the Poly-carbonmonofluoride (BR series) lithium batteries or the Manganese dioxide (CR series) lithium batteries either with a height, preferably of 3 mm or less, manufactured by Matsushita Electric Corporation of America (Panasonic). The above examples of button batteries are not an exhaustive list of possible power supplies, nor is the above list intended to act as a limitation on the doctrine of equivalents. A flexible flat power supply manufactured by Paper Power in Israel, may also be adapted as a power supply (FIG. 2E), dependent on the current and amperage requirements of the selected LED.

In another embodiment the LED 100 may have flat mounting tabs 110 extending from, or affixed to, its sides (FIG. 2A) which are useful to facilitate fast and accurate placement and mounting of the LED 100 within the LED mount 14. Shown in FIGS. 2B and 2C are tab catches 41 which are formed during molding of the inner body 13. To mount an LED 100 with mounting tabs 110 the LED 100 is pressed into the tab catch 41 and the tabs 110 may be pressure fit against the side walls 42 of the tab catch 41 bend the tab catches 41. The pressure fit may be adequate to hold the LED firmly in place, or it may be used in combination with adhesive or tape. A resistor 560, or other current limiting device, may be placed in the circuit, between the batteries and LED 100 to control the current supplied to the LED. The LED may have an integral focusing lens at a pre-determined fan angle.

The use of multiple LEDs (FIG. 2D) is achieved by placing the LEDs 100 and an auxiliary LED 100' in the LED mount 14 and connecting them in series, whereby the first LED lead wire 101 extends from the LED 100 and the second LED lead wire 102 extends from the auxiliary LED 100'. The wavelength of the single or multiple LEDs may be selected in accordance with the intended usage. In multiple LED instances LEDs of similar or dissimilar beam characteristics (fan angle) and/or wavelengths may be selected. The choice of LEDs with different fan angles, can yield a card light with a spot focused LED and a flood focused LED.

Figure 2E:
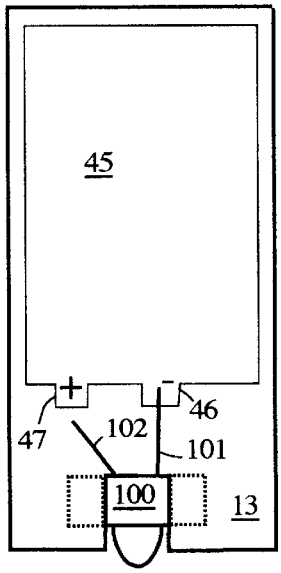
FIG. 2E is a top view of a third alternate embodiment of the card light
Figure 2D:
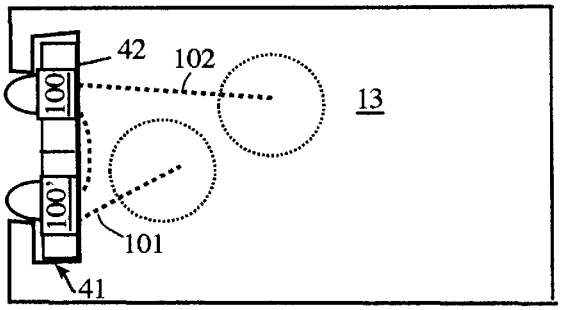
FIG. 2D is a top view of a second alternate embodiment of the card light

In another embodiment shown in FIG. 2E a layered flexible battery-supply 45 is affixed to, or formed as part of, the inner body 13 with its first terminal 46 conductively linked to the first LED lead wire 101 and its second terminal 47 remote from the second LED lead wire 102. At least a portion of the second LED lead wire 102 may be affixed to, or against the top surface of the inner body 13. As previously discussed, the second LED lead wire 102 may also be held within the and affixed to, the second LED lead wire guide (not shown). It is also possible to pre-shape a lead wire (FIGS. 2A & 3A), prior to mounting an LED, in one embodiment (FIG. 3A) an extended switching end 103 may be formed to place it at the top surface of the inner body 13.

Figure 3B:
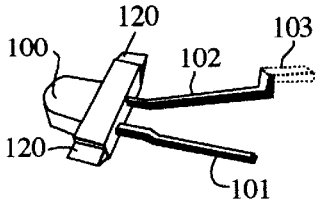
FIG. 3B is an alternate LED embodiment with extended switching lead for use in the embodiment of FIG. 3A.

In another embodiment (FIG. 3A) the LED 100 may have tapered mounting tabs 120 extending from, or affixed to, its sides. As shown in FIG. 3B the tapered mounting tabs 120 are useful in pressure fitting the LED 100 into the inner body 13 at the LED mount 14. A single battery 500 stack card light is also contemplated by this invention. In the single battery stack invention (FIG. 3B) the second battery holster 16 is eliminated and the second LED lead wire 102 may be raised, or have an extended switching end 103 to facilitate proper placement of the second LED lead wire 102 at or near the surface of the inner body 13, thereby facilitating switching (FIG. 1D) via the contact strip 550.

Since certain changes may be made in the above apparatus without departing from the scope of the invention herein involved, it is intended that all matter contained in the above description, as shown in the accompanying drawing, the specification, and the claims shall be interpreted in an illustrative, and not a limiting sense.

We claim:

1. A LED illuminator comprising:

a substantially planar outer casing with top, open bottom, sides and ends, adapted to slideably receive an inner body through at least one of its ends or sides;

a substantially planar inner body with top, bottom, sides, ends and an edge which slideably mates within the open bottom whereby the bottom of the inner body forms the bottom of the LED illuminator;

one or more light emitting diodes mounted along the edge of the inner body with a first and second lead wire;

a battery power supply with a first and second terminal mounted within the inner body with its first terminal conductively linked to the first lead wire;

a conductive contact strip affixed to, or formed as part of, the outer casing adapted to movably link the second terminal of the battery power supply to the second lead wire; and, a switch formed by sliding the inner body within the inner body receiving catch thereby aligning the contact strip with the top terminal and the second lead wire and supplying current to the one or more light emitting diodes.

2. The LED illuminator of claim 1 wherein at least a portion of the second lead wire is positioned along the top surface of the inner body.

3. The LED illuminator of claim 1 wherein the battery supply is selected from the groups consisting of one or more coin-type, button-type, lithium and flat paper batteries.

4. The LED illuminator of claim 1 wherein the edge of the inner body is angular and adapted to retain the inner body slideably within an angular catching edge of the outer casing.

5. The LED illuminator of claim 1 further comprising a current limiting device, such as a resistor, placed in-between on the light-emitting diode lead wire and one of the battery terminals; thereby controlling the current supplied to the light emitting diode.

6. The LED illuminator of claim 1 further comprising an LED mount, adapted to retain the one or more light emitting diodes, formed as part of the inner body.

7. The LED illuminator of claim 6 further comprising:

a battery holster, adapted to removably retain the battery power supply, formed as part of the inner body; and, a lead wire guide, formed as part of the inner body, adapted to direct the first lead wire to the bottom of the battery holster and place it in conductive contact with the first terminal of the battery.

8. The LED illuminator of claim 1 further comprising an auxiliary lead wire guide adapted to place the second lead wire in the proper location for switching.

9. The LED illuminator of claim 1 further comprising a focusing lens formed integrally as part of the one or more light emitting diodes whereby the fan angle of the output is predetermined.

10. The LED illuminator of claim 9 further comprising one or more auxiliary light emitting diodes placed in series with the one or more light emitting diodes.

11. The LED illuminator of claim 10 wherein the one or more auxiliary light emitting diodes have focusing lenses integrally formed therein, each with a fan angle which may be similar or dissimilar to the fan angle of the one or more light emitting diodes.

12. The LED illuminator of claim 10 wherein the wavelength of the one or more auxiliary LEDs may be similar or dissimilar to the wavelength of the one or more light emitting diodes.

13. The LED illuminator of claim 1 wherein representational material is, formed as part of, affixed or attached to the LED illuminator.

14. A LED illuminator comprising:

a substantially flat outer casing with top sides and open bottom; a body receiving catch formed in the open bottom;

a flat substantially planar plastic inner body, with an angular edge, adapted to slideably latch with the body receiving catch fitting into the open bottom;

a LED mount formed within the inner body extending through a portion of the inner body;

a first and a second battery mounted within the inner body, each with a first and a second terminal;

a LED adapted to seat within the LED mount with a first lead wire in conductive contact with the first terminal of the first battery and a second lead wire in conductive contact with the first terminal of the second battery;

a conductively contact strip affixed to or formed as part of the top wall of the body receiving catch adapted to serially link the second terminals of the first and second batteries; and, a sliding switch formed by the movement of the inner body within the body receiving catch by which an operator may selectively switch "on" the current to the LED by moving the inner body forward within the receiving catch thereby protruding the LED beyond the outer casing and aligning the contact strip with the top terminals.

15. The LED illuminator of claim 1 wherein the battery supply is selected from the groups consisting of one or more coin-type, button-type, lithium and flat paper batteries.

16. The LED illuminator of claim 1 wherein the edge of the inner body is angular and the body receiving catch is adapted to retain the inner body by the angular inner body edge.

17. The LED illuminator of claim 14 further comprising a current limiting device, such as a resistor, placed in-between on the LED lead wires and one of the battery terminals; thereby controlling the current supplied to the LED.

18. The LED illuminator of claim 14 further comprising:

a first battery holster, adapted to removably retain the first battery, formed as part of the inner body;

a second battery holster, adapted to removably retain the second, formed as part of the inner body;

a first lead wire guide, formed as an open channel in the inner body, adapted to direct the first lead wire to the first terminal of the first battery holster; and, a second lead wire guide, formed as an open channel in the inner body, adapted to direct the second lead wire to the first terminal of the second battery holster.

19. The LED illuminator of claim 14 further comprising a focusing lens formed integrally as part of the LED whereby the fan angle of the output is predetermined.

20. The LED illuminator of claim 14 further comprising one or more auxiliary LEDs placed in series with the LED.

21. The LED illuminator of claim 20 wherein the one or more auxiliary LEDs have focusing lenses integrally formed therein, each with a fan angle which may be similar or dissimilar to the fan angle of the LED.

22. The LED illuminator of claim 20 wherein the wavelength of the one or more auxiliary LEDs may be similar or dissimilar to the wavelength of the LED.

23. The LED illuminator of claim 14 wherein representational material is, formed as part of, affixed or attached to the LED illuminator.

24. The LED illuminator of claim 14 further comprising texture on at least one of the inner body and outer casing.

25. The LED illuminator of claim 14 further comprising one or more flat mounting tabs extending from the LED adapted to encourage the LED to remain within the LED mount.

26. The LED illuminator of claim 6 further comprising one or more tapered mounting tabs extending from the LED adapted to encourage the LED to remain within the LED mount.

27. A slide-switched illuminator comprising:

a substantially card shaped outer casing, with sides, a top surface which may be textured and with a body receiving catch formed in its open bottom;

a catching edge formed through one or more sides or ends of the outer casing communicating with the open bottom defining the body receiving catch;

a flat substantially planar plastic inner body, with a latching edge, which may have a textured bottom, and is adapted To slideably mate with the body receiving catch of the outer casing;

a LED mount formed within the inner body extending through a portion of the inner body;

a first and a second battery;

a first battery holster, adapted to removably retain the first battery, formed as part of the inner body;

a second battery holster, adapted to removably retain the second, formed as part of the inner body;

a first lead wire guide, formed as part of the inner body, adapted to direct the first lead wire to the bottom of the first battery holster; and, a second lead wire guide, formed as part of the inner body, adapted to direct the second lead wire to the bottom of the second battery holster;

a LED adapted to seat within the LED mount with a first lead wire in conductive contact with the bottom terminal of the first battery and a second lead wire in conductive contact with the bottom terminal of the second battery;

a conductively contact strip affixed to or formed as part of the top wall of the body receiving catch adapted to serially link the top terminals of the first and second batteries; and, a sliding switch formed by the movement of the inner body within the body receiving catch by which an operator may selectively switch "on" the current to the LED by aligning the contact strip with the top terminals.

28. The slide-switched illuminator of claim 14 wherein representational material is, formed as part of, affixed or attached to the LED illuminator.

29. The slide-switched illuminator of claim 27 further comprising one or more flat mounting tabs extending from opposite sides of the LED adapted to encourage the LED to remain within the LED mount.

* * * * *